US008863314B2

(12) United States Patent
Raviv

(10) Patent No.: US 8,863,314 B2
(45) Date of Patent: Oct. 21, 2014

(54) GARMENT SMARTPAD HOLDER

(76) Inventor: Ben Raviv, San Francisco, CA (US)

( * ) Notice: Subject to any disclaimer, the term of this patent is extended or adjusted under 35 U.S.C. 154(b) by 281 days.

(21) Appl. No.: 13/234,068

(22) Filed: Sep. 15, 2011

(65) Prior Publication Data

US 2012/0060255 A1 Mar. 15, 2012

Related U.S. Application Data

(60) Provisional application No. 61/383,261, filed on Sep. 15, 2010.

(51) Int. Cl.
*A41B 1/00* (2006.01)

(52) U.S. Cl.
USPC ..... 2/115; 2/94; 2/119; 2/247; 2/252

(58) Field of Classification Search
USPC ..... 2/115, 108, 93–94, 102, 85, 247, 2/248–252, 254, 69, 86; 150/115, 120
See application file for complete search history.

(56) References Cited

U.S. PATENT DOCUMENTS

| | | | | |
|---|---|---|---|---|
| 283,609 | A * | 8/1883 | Kahn | 2/251 |
| 2,069,643 | A * | 2/1937 | Burke | 604/292 |
| 2,265,690 | A * | 12/1941 | Fiedler | 2/48 |
| 2,520,285 | A * | 8/1950 | Olson | 2/94 |
| 2,717,391 | A * | 9/1955 | Bracken | 2/94 |
| 2,853,709 | A * | 9/1958 | Peterson et al. | 2/51 |
| 4,630,319 | A * | 12/1986 | Mathis | 2/250 |
| 5,526,535 | A * | 6/1996 | Dobrzenski | 2/102 |
| 5,884,338 | A * | 3/1999 | Golde | 2/247 |
| 6,279,162 | B1 * | 8/2001 | Silverthorn | 2/108 |
| 6,729,520 | B2 * | 5/2004 | Gilbert | 224/625 |
| 6,883,178 | B2 * | 4/2005 | van der Sleesen | 2/69 |
| 6,962,277 | B2 * | 11/2005 | Quintana et al. | 224/262 |
| 7,676,348 | B2 * | 3/2010 | Okada | 703/2 |
| 2002/0121322 | A1 * | 9/2002 | Seamon | 150/113 |
| 2007/0245444 | A1 * | 10/2007 | Brink | 2/69 |
| 2009/0139013 | A1 * | 6/2009 | Sapowycz et al. | 2/247 |
| 2011/0139836 | A1 * | 6/2011 | Klann | 224/101 |
| 2011/0162121 | A1 * | 7/2011 | Klann | 2/69 |
| 2012/0000003 | A1 * | 1/2012 | Matthews | 2/69 |

* cited by examiner

*Primary Examiner* — Khoa Huynh
*Assistant Examiner* — Brieanna Fuller
(74) *Attorney, Agent, or Firm* — Donn K. Harms

(57) ABSTRACT

A garment mounted storage compartment for support and transport of a planar electronic device such as a tablet computer having a video screen. The device features a compartment which has a rotatable flap with supports to position the electronic device in front of the user's eyes and in a position for operation with the user's fingers. Support while walking or sitting allows the user to operate the electronic device.

8 Claims, 3 Drawing Sheets

GARMENT SMARTPAD HOLDER

This application claims priority to U.S. Provisional Application Ser. No. 61/383,261 filed on Sep. 15, 2010 and incorporated in its entirety herein by this reference.

BACKGROUND OF THE INVENTION

1. Field of the Invention

The present invention relates to securing and supporting electronic devices with clothing. More particularly, the invention relates to a garment compartment configured to operatively support small smartpad electronic devices in and the like in a viewable and usable position, while concurrently providing user access and storage of the supported device for normal use, without the need for the user to add support.

2. Prior Art

Smartpad is a fairly new term of art used generally to describe electronic computing devices having screens slightly larger than handheld phones yet smaller than laptops. Such devices generally sport a seven to ten inch diagonal screen. Such electronic devices, also as a rule, employ the most recent advances in touch screen technology and presently include such devices similar to personal digital assistants (PDA's) and more predominantly the iPad by Apple Computers. Because of the popularity and portability of these devices, their use has evolved wherein they are now employed in a portable fashion, rather than just at work or a home office. In many cases these smartpad devices substitute for the user employing a more bulky laptop portable computer.

Conventionally, these smartpad devices are transported by hand and may be carried within sleek covers of neoprene or rip stop type material. Or they may be transported with carrying cases which are supported by the user around the shoulder, or frequently they are transported in a shoulder-engaged backpack. It is not surprising that because of the substantial functional range, and ease of use afforded by these devices, it is desirous of most users to have them accompany them much like a cellphone.

As a consequence, a need for convenient methods of transporting smartpads and protecting their screen and components has arisen. Since the devices purposely are not laptop computers, the bulky handled carrying cases of laptops are not desirous of a smartpad user vying for portability and ease of function. Consequently, a need for a transport housing or container which also allows for on-the-go concurrent use, for instance while walking or standing around, has also evolved. Many attempts to resolve this need for support for transport and ease of concurrent use are seen in garment integrated systems.

Conventional devices for transport of the seven to ten inch smartpads, include a substantially transparent or open window area, communicating with a cavity or compartment of a carried bag or garment. This allows for discreet viewing of an electronic device from its position within the compartment or cavity. Although providing on-the-go storage and transport capabilities, conventional carriers require direct user interaction to place and to retain the position of the electronic device relative to their eyes and its viewing window in order to see it for use. Since the device is generally carried in a compartment or covered bag, use on-the-go while walking or standing involves finding somewhere to sit down and placing the smartpad on a table or holding the smartpad or tablet in the user's hand, which can become cumbersome after an extended period of time.

Also, conventional transport components for smartpads provide a relatively small viewing area, for smaller phone-like handheld electronics, by surrounding it with a fabric frame which does not adapt to larger screened smartpad devices, or the touch screen operation characteristics required of the software running on conventional smartpads. Additionally, a larger viewing window, if employed by conventional transport devices attempting to accommodate the screen size and interaction needs of smartpads, would greatly impair the aesthetic appeal if the transport device is a purse, case, or a worn garment and is generally undesirable.

Pub. Nos. US2005/0246823A1 to Groom, US2007/0245444A1 to Brink, and US2006/0206990 to Demus as well as similar devices teach garment-adapted containers used for storage and transport of small electronic devices providing means for wired communication to the user by employing earphones or microphones. These prior art inventions however, either do not allow operational employment to position a smartpad computing device in a manner allowing the user to employ the physical requirements for operating smartpad devices. Further, most such conceptional components generally lack a means to operationally interact and interface the user with such smartpad devices, especially for use on-the-go or while standing such as in a line or in an airport.

As such, there is a continuing unmet need for an improved garment-based transport and storage device which is configured of easily engaged and operated garment components, and which will provide a means to transport a smartpad computing device in a protected and padded environment, while concurrently allowing for comfortable and easy on-the-go use and user interaction with such smartpads. Such a device should preferably also render the garment fashionably acceptable to encourage use and sales.

SUMMARY OF THE INVENTION

The device and method herein disclosed and described achieves the above-mentioned goals through the provision of a specialized storage compartment formed upon a garment such as a pullover or shirt or coat or other outer garment. The compartment is preferably formed in a frontal area of the garment in front of the user's face. It is also preferable that the compartment be positioned lower than the shoulders and above the waist of the user, in order to allow easy access by their hands in a natural and comfortable stance.

The invention as disclosed and described herein overcomes the shortcomings of the past. The device allows the user wearing the garment, employing the properly positioned compartment, to carry a smartpad device within the compartment formed on the garment, proximate to the user's chest where it allows easy and natural arm and finger access when needed. The device provides this dual function in a fashionably acceptable manner which does not render the garment unattractive thereby allowing for widespread use. Additionally, the disclosed device concurrently provides the user employing it for storage and transport, a continuous means for support of, and hand operated use of, the contained smartpad device.

Access to the stowed smartpad to a properly positioned and hand-use positioned and supported smartpad, is afforded by a simple opening of the hidden compartment to its support position from a stowed position. The opening of the compartment allows the user to concurrently deploy a support shelf on which to operationally support the smartpad at a level comfortable for operation by the user's hands. Further, so supported, the user can employ their hands and fingers to operationally interact with the smartpad device on-the-go, while the user is walking, standing, sitting in public or riding on private transport. All the while the smartpad needs no table or support furniture and is held in an elevated position which is comfortable for the user to interact with, and in position for viewing by the eyes of the user without turning their head.

The compartment device as formed includes a flap of a substantially rectangular shape which is similar to the shape of conventional smartpad devices. The rectangular flap includes left, right, top and proximal edges and has an inner and outer surface. The flap is engaged to, or formed in a unitary structure with, the fabric or textile material forming the chest area of a garment worn by a user and is preferably positioned between the shoulders and waist of the user to afford comfortable use. Securement is provided at least on the proximal edge of the flap on the inner surface which when closed and attached to the garment is adjacent to the garment.

Means of engagement of the bottom or proximal edge of the flap, furthest from the user's face but closest to their hands while wearing the garment, can be, but is not limited to clothing type means of attachment including sewing, fasteners, or adhesive. The remaining edges of the flap, left, right, and top, employ removable means of engagement to the surrounding garment, such as a zipper, hook and loop fabric, fabric fasteners, or similar removably engageable fasteners providing means to removably engage the flap, to either a portion of the compartment engaged to the garment, or simply to the surrounding garment when the carried smartpad is not being operated while the flap is closed.

Engaging all edges of the flap to either another portion of the compartment attached to the garment, or to the garment directly, provides a means for full securement of the flap to the garment in a closed position to thereby securely hold a smartpad in the formed compartment such that it will not dislodge while walking, running, or making other movements.

In another mode of connection, when only the left and right edges are removably engaged, and the proximal edge permanently engaged, a compartment with a storage cavity is formed in which a smartpad device can be inserted through the means of ingress provided by either of the sides if open.

The flap covering the formed storage cavity of the storage compartment is deployable from a stored position, engaged to the garment or to a portion of the compartment engaged to the garment, to an as-used position. In this as-used position, two side edges and the edge closest to the user's chin are released from their engagement to the garment or the compartment.

In use, moving from the stored position to the as-used position, supporting the electronic smartpad for on-the-go use, the top edge, left edge, and right edge are disengaged from their removable attachment to the compartment or garment. Next the flap is allowed to rotate on its connected edge, outward in a direction away from the user's chest about the engaged proximal edge.

This rotation of the flap proceeds to a substantially perpendicular position relative to the user's chest, or substantially 90 degrees to the user's chest surface, and substantially parallel with the support surface supporting the standing user wearing the garment.

Rotated to the provided 'as-used' position, the flap of the device is maintained substantially traverse or perpendicular to the surface of the user's chest for the duration of desired use through the provision of proximal straps. The left and right edges of the deployable flap are each engaged adjacent to their respective distal ends to the distal ends of separate support straps. The proximate ends of the support straps are engaged on their respective sides on the deployed flap, or upon the compartment on respective sides of the flap.

In the as-used position of the horizontally deployed flap, the inner surface of the flap provides a shelf-like support on which an overlaid smartpad device can be rested or secured for use. Because the flap is supported in the horizontal as-used position and supports the smartpad, which may be removably secured to the flap, the pad device may be operated without need for the user to support it with their hands, or a surface thereby allowing use while the user is walking, running, sitting, or riding in a vehicle.

When the compartment flap is rotated on its lower surface to the closed position, prior to engagement of the releasable fasteners, the support straps are configured to operatively fold into the storage compartment. This is done in one simple fashion by the engagement of elastic bands between the backwall of the compartment and a central area of the straps. Consequently, as the flap is rotated closed, the elastic bands pull the straps away from the two edges of the flap, and out of danger of becoming tangled in the removable closures. Alternatively, curved plastic shaped members may be employed which straighten under the weight of the supported computer or smartpad in the as-used condition, but return to their curved memorized position away from the edges once that weight is removed. These plastic or flexible members with a memorized shape can also engage with the distal end of the flap in an adjustable manner such as with teeth on the plastic members engaging a ratchet on the flap. Sliding the ratchet on the flap, up the plastic member will adjust the angle of the flap in the as-used position. Of course those skilled in the art will realize that other means to bias the support straps inward can be employed and all such means to bias the support straps as would so occur are considered within the scope of this application Additionally if desired, the support straps may be rendered adjustable to allow for any horizontal position of the inner surface of the flap the user wishes to provide a means to support the smartpad or pad computer in a manner as per a user's desire. This adjustable angle is especially important to user's who may be sitting or standing in various positions where their back may not be substantially perpendicular to the surface supporting them, or where the display screen on the electronic device being supported has a narrow viewing angle, or has glare upon it.

The inner surface of the flap is designed such that a smartpad device can be held securely, yet removable within the compartment so that the smartpad or computer device does not move around inside the compartment when the user is moving, or stops moving. Means for removable secure securement of the smartpad or pad computer device can be ridged plastic, webbing, elastic fabric, hook and loop fasteners, or cooperating mating fasteners of the like. They are placed adjacent to at least two and preferably all four corners of the inner surface of the flap, in a registered positioning for an engagement with a cooperating fastener half attached to the smartpad device. So placed and engaged, the smartpad or pad computer or other flat device is securely engaged to the inner surface of the flap, and will not interfere with the viewing screen of the device when moved to the as-used position.

Additional support means is provided in the architecture of the garment allowing for distribution of the weight of the secured smartpad device. A means to provide weight distribution of the supported computing device or smartpad, to a wider surface area of the garment and wearer, is provided by a network of reinforced stitching, elastic material or the like, extending from the compartment location on the garment.

These reinforcements extend upward toward the shoulders of the garment as well as around to the back of the garment providing a distribution of weight from the compartment and supported device, that would normally be focused on and to the garment fabric positioned on the front chest area of the garment where the compartment is located. This distribution reduces the perceived weight of the smartpad device as experienced by the user wearing the garment and thereby provides a means to reduce back and neck strain to the user wearing the garment housing for an extended period of time.

The top edge of the deployable flap preferably contains a flap extension. This extension can be engaged and positioned to provide a means for shade from the sun or overhead lighting as well as security from others possibly viewing the supported display screen from a proximate location. The extension is defined by top, bottom, left, and right edges and is engaged at or adjacent to the bottom edge of the extension to or adjacent to the top or distal edge of the flap. It can be deployed to follow or slide upon the support straps as high up as needed for either shade or security. Securement is by means of sewing or hook and loop disengageable fasteners or other cooperative fasteners of the like as would occur to those skilled in the art.

Secondary proximal supports which are similar to the proximal straps of the flap, are engaged at a distal end to the upper corners of the extension, along with the proximate end of the supports being engaged to the garment and thereby provide a means to secure the extension to the garment at an angle over the flap providing optimal sun protection. The extension is preferred to be of substantially less girth as to not obstruct the wearer from seeing the entire video display of the smartpad device when in the as-used position and supported on the flap. Similar such extensions may be employed in vertically deployed positions supported by the support straps on the left and right edges of the flap providing sun protection from those directions as well.

The compartment may also accommodate a stealth connecting of the smartpad device to earphones or microphones. This can be done by means of a placket located near the top edge of the compartment flap.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of this invention to provide an improved means for worn-garment transport and on-the-go use of smartpad type electronic computing and communication devices through the provision of a specialized compartment located on the chest of a garment.

It is an additional object of this invention to allow for the compartment to be opened on three of four edges and rotated to provide a support shelf where a wearer can access and use the smartpad device while walking or sitting.

It is yet another object of this invention to engage the smartpad device securely to the flap of compartment.

It is still another object of this invention to support the weight of the engaged smartpad or pad computing device through an integrated network of reinforcement straps or sewing providing a distribution of weight about the garment.

It is still yet another object of this invention to provide a means for stealth wired connection of headphones or microphones to the smartpad device while positioned in the compartment.

It is a further object of this invention to provide a means to shade the display screen of an engaged smartpad or other electronic device display from direct sunlight or unwanted viewers without obstructing the wearer's view of the engaged smartpad device.

BRIEF DESCRIPTION OF DRAWING FIGURES

DETAILED DESCRIPTION OF THE PREFERRED EMBODIMENTS OF THE INVENTION

Figure 1:
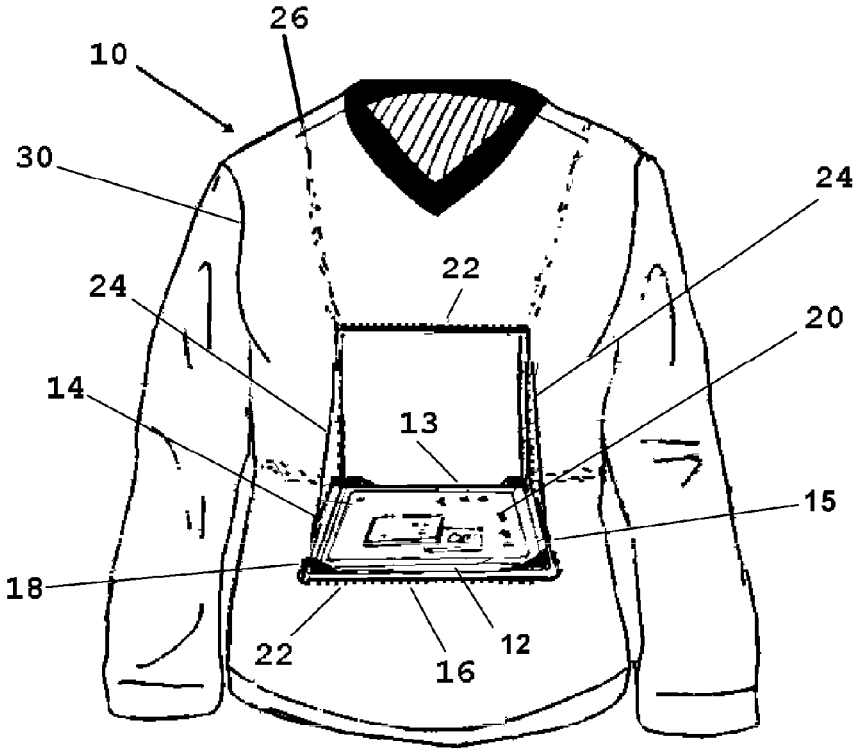
FIG. 1 depicts a frontal view of a preferred mode of the invention in the open or as-used position positioning the smartpad or computer display device horizontally in front of the user in a position for comfortable use.

Referring now to the drawings of FIGS. 1-6, there is seen in FIG. 1 a preferred mode of the device 10 with flap 12 in the open as-used position in front of and below the face and chest of a user wearing the garment which is a natural position for the use and employment of electronics having a display screen and graphic interface operated by hand. The bottom or proximal edge 13 of the flap 12 is engaged to the garment 30 at or near the chest and abdomen area of the wearer in a manner to allow rotation of the flap in this engagement. The remaining perimeter edges consisting of right 14, left 15, and top 16 edges employ means for removable engagement to the adjacent garment body. Such means for removable engagement can be one or a combination of a zipper 22, cooperating fasteners, hook and loop fabric, or other removably engageable means of engagement of the edges of the flap 12 to the adjacent frontal surface of the user-worn garment 30.

When the flap 12 is positioned adjacent to the garment 30 in the closed or secured position forming the interior cavity, there is seen the cooperating zipper 22 portions on the flap edge and garment 30 which fully removably engage the flap 12 vertically to the garment 30. Other means of engagement may also be hook and loop type fasteners, cooperating fasteners such as buttons or hooks, and the zipper 22 while preferred for forming an especially secure connection, is shown merely for demonstrative purposes.

The electronic device with a video display, such as a smartpad device 20, is shown removably engaged to the interior surface of the flap 12 using corner restraints 18 which as shown are triangular shaped fabric covers positioned to engage over at least two of, but preferably all four of the corners of the smartpad device 20, so it may be slipped into all four corners easily.

The overlapping corner restraints 18 depicted as noted are triangular or other conveniently shaped gussets and can be formed of elastic material to provide a biased engagement of the corners, or fabric, or straps, or webbing, or the like, sewn or attached whereby the smartpad 20 is merely slipped thereunder. It should be noted that such engagement means could take on other forms such as but not limited to hook and loop type fasteners which would require placing fasteners on the secured device or smartpad 20 which is not preferred but possible.

Support straps 24 provide the means for maintaining the substantially horizontal positioning of the flap 12 and smartpad 20 to the as-used position where the user may operate the device supported by the flap 12 concurrently. The straps 24 can be any material adapted to the task such as thin webbing or a chord or wire rope, or similar lightweight strong material. One distal end of each strap 24 is engaged via sewing or other operative means to the right 14 and left 15 edges of the flap 12 adjacent to the distal end of the flap 12. The other proximal end of the straps 24 is engaged to the corresponding position on the garment 30 or the device 10 which would be secured to the garment 30.

Reinforced stitching 26 depicted by the dashed lines can be seen operatively situated within the architecture of the garment 30. The network of stitching 26 of the fabric forming the garment 30, forming darts or seams or just decorative lines, extends over the shoulders and around the waist of the garment 30. It can be formed of reinforced seams, overlock stitching, or other stitching, or seams with stitching and multiple fabric layers. So positioned and terminating at the upper and lower positions of the formed compartment device 10 as in FIGS. 2 and 4, this network of reinforcing serves to divide and support the majority of the weight of the smartpad 20 engaged with the device 10 thereby providing a means to reduce the apparent or perceived weight experienced by the wearer. Without the stitching 26 or similar reenforced bands in the fabric of the garment 30 it would tend to sag in the area of the chest under the neck and in time overstretch. Thus, the stitching and or seams form a pair of reinforcing support bands over the shoulder and one around the waist to distribute the weight of the carried smart device to a wide area of the garment 30.

Figure 2:
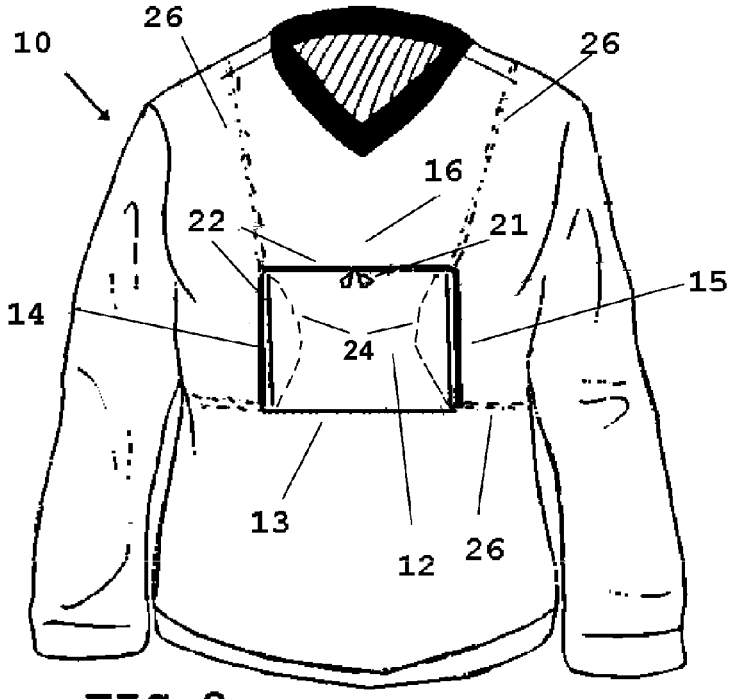
FIG. 2 depicts the device with the flap in the closed position secured to the chest area of the garment worn by the user.

FIG. 2 shows the closed or stored position of the device 10 with the flap secured to the surrounding fabric of the device or the garment 30. In this closed position, the zipper 22 or similar easily disengaged fastener is fully engaged about the right 14, left 15, and top 16 edges of the flap 12 with zipper pull tabs 21 secured centrally about the top 16 edge. The area of the garment 30, proximate and in contact with the display screen of the vertical and stored smartpad device is formed of such material so as to protect and not damage the sensitive touch screen often employed by smartpad devices.

Figure 3:
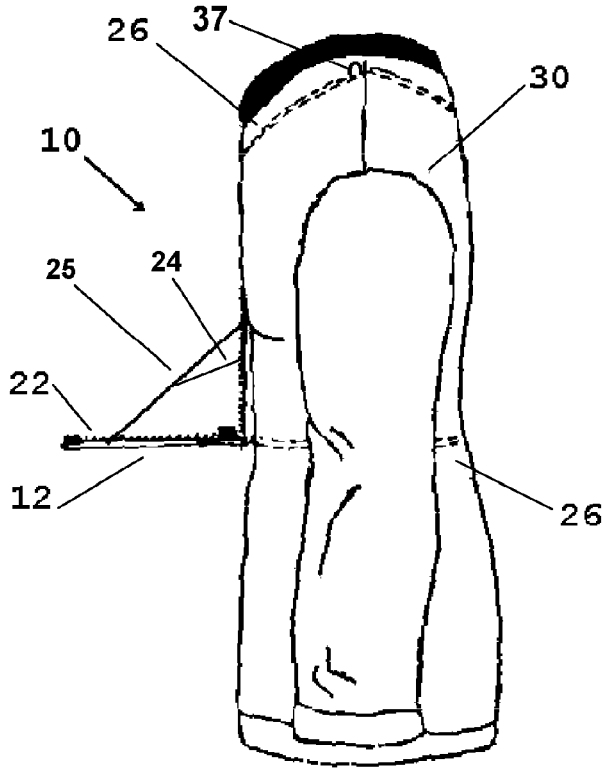
FIG. 3 depicts the side view of the device in the as-used position, showing the support straps maintaining the flap and smartpad at a substantially horizontal as-used position.
Figure 5:
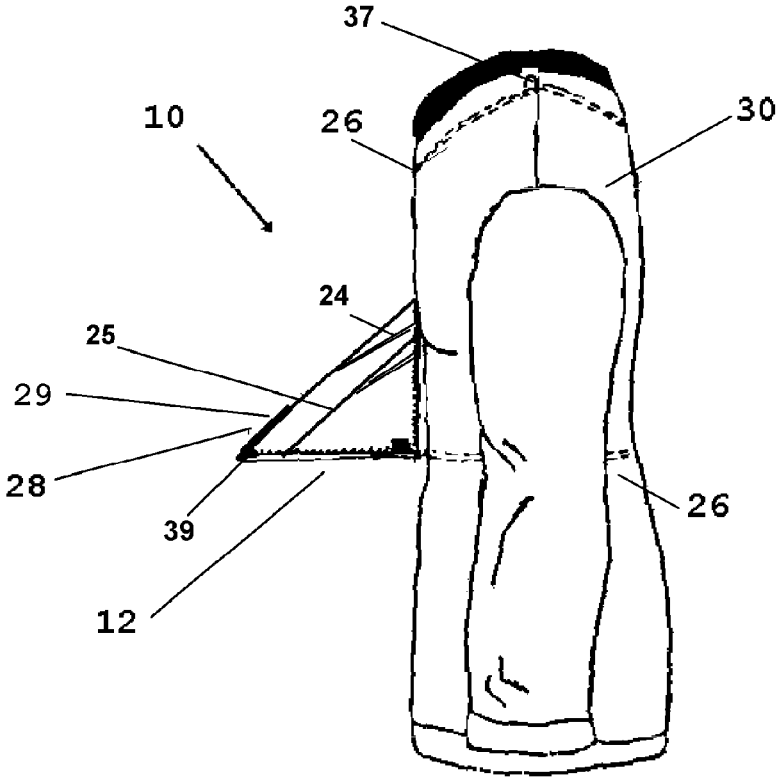
FIG. 5 depicts a side view of the invention as described in FIG. 4 showing the support straps which may be memory shaped or engaged to biasing means to pull them inward.

A side view of the device 10 when in the open as-used position is seen in FIGS. 3 and 5. In FIG. 3 the function and position of the support straps 24 is better portrayed. Again it is noted that the support straps 24 aid to maintain the substantially horizontal position of the flap 12 in this as-used position. As noted, it is preferred that the support straps 24 automatically move out of the way of the closing zipper or other fasteners used to close the flap 12. One means for biasing the central portion of the support straps 24 away from the side fasteners is the employment of an elastic band 25 engaged between a central portion of the straps 24 and the middle area 27 of the device 10. The weight of the electronic device supported on the flap 12 will maintain the straps 24 straight and aligned. Once the weight is removed during closure, the elastic bands 25 contract to bias the straps 24 away from the edges where the fasteners close.

Alternatively, the support straps 24 may be formed of a memory material such as formed plastic such as polyethylene formed in a curve. (also in FIG. 6) The support straps 24 would be engaged in the same fashion as above, however between the two engaged ends of the straps 24, the curve will return once the weight is removed from the flap 12 they support. The straps 24 would be engaged so the arc of the curve is toward the center area 27 of the device 10 (in dotted line in FIG. 2) thereby biasing them out of danger from becoming tangled in the zipper or other fasteners on the edges during a closing.

Figure 4:
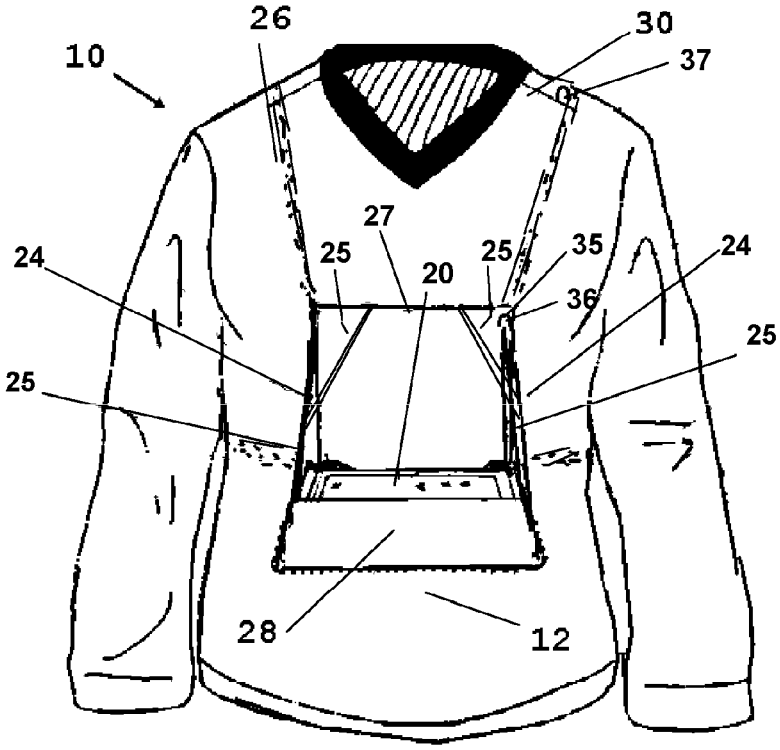
FIG. 4 depicts a front view of another mode of the invention with an optional extension engaged to the flap and providing a means to shade the viewing screen of the smartpad device.

Another mode of the device 10 is seen in FIG. 4 where a flap extension 28 is shown in the as-used position and provides a means to shade the smartpad 20 from overhead light and prying eyes. The extension 28 is maintained in its position via fasteners 29 which allow it to follow the line of the straps 24 and be held elevated above the supported electronic device. Another depiction of the engaged extension 28 is seen in the side perspective view in FIG. 5. The extension 28 user-positioned so as to not obstruct the line of sight of the user to the video display of smartpad 20.

The compartment may also accommodate a stealth connecting of the smartpad 20 or other device to earphones or microphones which may be communicated to the user for use. This can be done by means of a placket 35 located near the top edge of the compartment flap 12 or alternatively, forming a channel within the fabric of the garment 30 using the path of the stitching 26. The channel will communicate at a first end with the interior of the device through an opening 36 and a second opening 37 near the neck area of the garment 30. The user can easily run the earphone or microphone wires through the channel allowing a stealth or hidden manner to route them for use.

Figure 6:
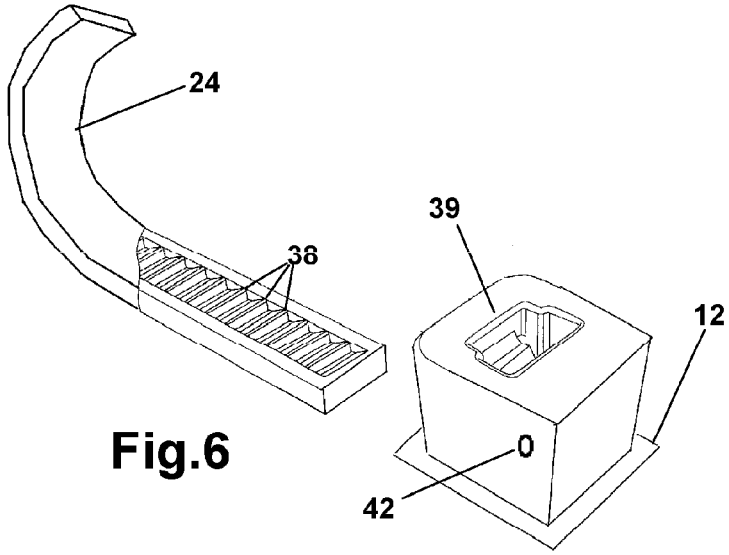
FIG. 6 depicts the support members for the flap formed of curved memory material and having a geared surface and cooperating attachment for adjusting the angle of the flap.

FIG. 6 depicts the support straps 24 for the flap which are formed of curved memory material whereby removal of weight from the flap they engage and support causes them to return to a curve and move away from the fasteners on the edge of the flap 12. Additionally, the straps 24 in all modes may have means for adjustment of the flap angle such as a geared surface 38 and a cooperating releasable component 39 attached to the flap 12. Sliding the geared surface 38 into the releaseable component 39 will increase or decrease the angle of the flap 12 in the as-used position depending on the direction of slide. A release 42 allows for rearward slide or disengagement.

While all of the fundamental characteristics and features of the garment smartpad support and transport device and system have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions as would occur to those skilled in the art, are included within the scope of the disclosed system and apparatus herein as defined, but not limited, by the following proposed tentative claims.

What is claimed is:

1. A shirt mounted support and transport apparatus adapted for storage and a positioning for use of a planar electronic device having a video display comprising:

a shirt worn upon the torso of a wearer having a neck opening and sleeves;

a front portion of said shirt positionable over the chest and abdomen of the wearer;

a storage compartment formed upon said front portion of said shirt in a central area of said front portion, said central area being between said neck opening and a bottom edge of said shirt;

said storage compartment having a back wall and a front wall defining a storage cavity therein adapted in size for said planar electronic device;

a flap portion of said front wall separable from said back wall on two opposing side edges and a top edge, said top edge intersecting said opposing side edges at opposite corners, said top edge opposite a bottom edge engaged with said back wall;

a pair of flexible support members engaged at respective ends with said shirt and at a respective engagement proximate to one of said corners of said flap portion;

said flap portion movable from a stored position substantially vertical with said top edge, and opposing edges proximate to said back wall, to an as-used position substantially perpendicular to said back wall;

removable means of engagement of said top edge and said opposing side edges to said back wall adjacent thereto in said stored position, to maintain said flap portion in said stored position;

means to bias said flexible support members respectively away from said opposing side edges during a return of said flap portion to said stored position to position said flexible support members out of potential engagement with said removable means of engagement of said opposing side edges;

wherein said removable means of engagement of said opposing side edges is a zipper; and said means to bias said flexible support members away from a respective adjacent said opposing side edges comprises an elastic band connected at a first end at a center area of one of said respective said flexible support members between said shirt and one of a respective said corners of said flap portion and at a respective second end in a central area of said back wall, wherein said flexible support members are biased away from said zipper as said flap portion is moved to said stored position; and said flap portion in said as-used position defining a support surface for said planar electronic device having said video display, wherein said wearer can employ their hands and fingers to operate said planar electronic device while standing or walking without having to hold said electronic device in front of them.

2. The shirt mounted support and transport apparatus of claim 1 additionally comprising:

means for a releasable engagement of said planar electronic device to said flap portion; and said planar electronic device in said releasable engagement moveable from said as-used position to said stored position without a dislodging from said flap portion.

3. The shirt mounted support and transport apparatus of claim 1 additionally comprising:

two vertical bands of stitching reinforcement formed in said shirt extending along a path from a position proximate to said storage compartment and over shoulder portions of said shirt; and said two vertical bands of stitching reinforcement providing means to disburse a weight of said planar electronic device positioned in said storage compartment to said shirt along said path of said two vertical bands of stitching reinforcement.

4. The shirt mounted support and transport apparatus of claim 3 additionally comprising:

a conduit formed by one of said two vertical bands of stitching reinforcement within said shirt;

said conduit extending between a first opening proximate to said storage compartment and a second opening proximate to said neck opening; and said conduit providing means to route wires for one or a combination of earphones and a microphone to the head of said wearer.

5. A shirt mounted support and transport apparatus adapted for storage and a positioning for use of a planar electronic device having a video display comprising:

a shirt worn upon the torso of a wearer having a neck opening and sleeves;

a front portion of said shirt positionable over the chest and abdomen of the wearer;

a storage compartment formed upon said front portion of said shirt in a central area of said front portion, said central area being between said neck opening and a bottom edge of said shirt;

said storage compartment having a back wall and a front wall defining a storage cavity therein adapted in size for said planar electronic device;

a flap portion of said front wall separable from said back wall on two opposing side edges and a top edge, said top edge intersecting said opposing side edges at opposite corners, said top edge opposite a bottom edge engaged with said back wall;

a pair of flexible support members engaged at respective ends with said shirt and at a respective engagement proximate to one of said corners of said flap portion;

said flap portion movable from a stored position substantially vertical with said top edge, and opposing edges proximate to said back wall, to an as-used position substantially perpendicular to said back wall;

removable means of engagement of said top edge and said opposing side edges to said back wall adjacent thereto in said stored position, to maintain said flap portion in said stored position;

means to bias said flexible support members respectively away from said opposing side edges during a return of said flap portion to said stored position to position said flexible support members out of potential engagement with said removable means of engagement of said opposing side edges;

wherein said removable means of engagement of said opposing side edges is a zipper; and said means to bias said flexible support members away from a respective adjacent said opposing side edges comprises said flexible support members formed of curved memory material having an arc when in said stored position and being substantially straight in said as-used position;

wherein a direction of said arc being away from said opposing side edges with said flap portion in said stored position;

an edge of each said flexible support members being cooperatively engageable with a receiving cavity, said receiving cavity providing said engagement proximate to one of said corners;

a distance between said engagement of said flexible support members with said shirt and said receiving cavity being adjustable by a translation of each said edge of said flexible support members through a respective said receiving cavity;

wherein an angle of said flap portion is adjustable by said translation of each said edge of said flexible support members through said respective receiving cavity thereby providing said wearer means of adjustment of a viewing angle of said video display of said planar electronic device; and said flap portion in said as-used position defining a support surface for said planar electronic device having said video display, wherein said wearer can employ their hands and fingers to operate said planar electronic device while standing or walking without having to hold said planar electronic device in front of them.

6. The shirt mounted support and transport apparatus of claim 5 additionally comprising:

means for a releasable engagement of said planar electronic device to said flap portion; and said planar electronic device in said releasable engagement moveable from said as-used position to said stored position without a dislodging from said flap portion.

7. The shirt mounted support and transport apparatus of claim 5 additionally comprising:

two vertical bands of stitching reinforcement formed in said shirt extending along a path from a position proximate to said storage compartment and over shoulder portions of said shirt; and said two vertical bands of stitching reinforcement providing means to disburse a weight of said planar electronic device positioned in said storage compartment to said shirt along said path of said vertical bands of stitching reinforcement.

8. The garment mounted support and transport apparatus of claim 7 additionally comprising:

a conduit formed by one of said two vertical bands of stitching reinforcement within said shirt;

said conduit extending between a first opening proximate to said storage compartment and a second opening proximate to said neck opening; and said conduit providing means to route wires for one or a combination of earphones and a microphone to the head of said wearer.

* * * * *